US005450682A

United States Patent [19]

Franco et al.

[11] Patent Number: 5,450,682

[45] Date of Patent: Sep. 19, 1995

[54] TRACK DISPLAY

[75] Inventors: George T. Franco, New York; Joey Melo, Mineola, both of N.Y.

[73] Assignee: Autoplax Corporation, New York, N.Y.

[21] Appl. No.: 329,669

[22] Filed: Oct. 27, 1994

Related U.S. Application Data

[63] Continuation of Ser. No. 44,294, Apr. 7, 1993, abandoned.

[51] Int. Cl.[6] ..... G09F 19/08

[52] U.S. Cl. ..... 40/415; 40/414; 446/447

[58] Field of Search ..... 40/411, 414, 415; 104/55, 56, 305; 446/444, 447; 191/53, 57, 63; 238/10 E, 10 F

[56] References Cited

U.S. PATENT DOCUMENTS

| | | | |
|---|---|---|---|
| 1,842,021 | 1/1932 | Hanley | 446/447 X |
| 2,787,088 | 4/1957 | Gridley | 40/415 X |
| 2,852,198 | 9/1958 | Kramer | 238/10 E X |
| 3,581,987 | 6/1971 | Tomaro | 238/10 E |
| 3,858,339 | 1/1975 | Short . | |
| 4,632,038 | 12/1986 | Lawrence | 238/10 E X |
| 5,211,366 | 5/1993 | Cummings . | |

FOREIGN PATENT DOCUMENTS

| | | | |
|---|---|---|---|
| 708187 | 4/1954 | United Kingdom | 104/305 |
| 764151 | 12/1956 | United Kingdom . | |
| 944367 | 12/1963 | United Kingdom | 238/10 E |
| 2129318 | 5/1984 | United Kingdom . | |

OTHER PUBLICATIONS

Hammacher Schlemmer & Co., Inc. Holiday 1993 Catalog, p. 46.

*Primary Examiner*—Brian K. Green
*Attorney, Agent, or Firm*—Steven H. Bazerman

[57] ABSTRACT

A track display apparatus comprises an elongated endless track preferably in the form of a ring. A pair of spaced apart conductive rails extend along the track and are engaged by conductive rollers which receive electrical power for a motor housing surrounded by an ornament. The ornament is advantageously Santa with his sleigh and the reindeer. Power is supplied by a power signal unit attached along the track and electrically connected to the rails and a low voltage direct current power source. A plurality of supports are connected around the track for supporting the track above the floor or around another ornament, for example, a Christmas tree.

28 Claims, 6 Drawing Sheets

FIG. 2
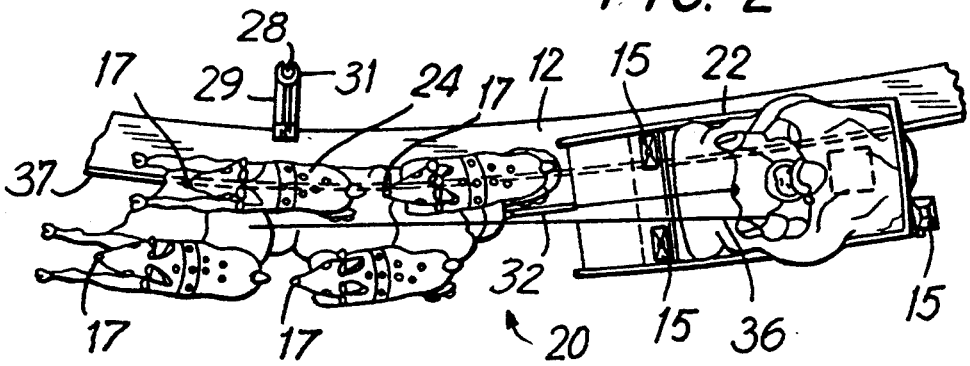
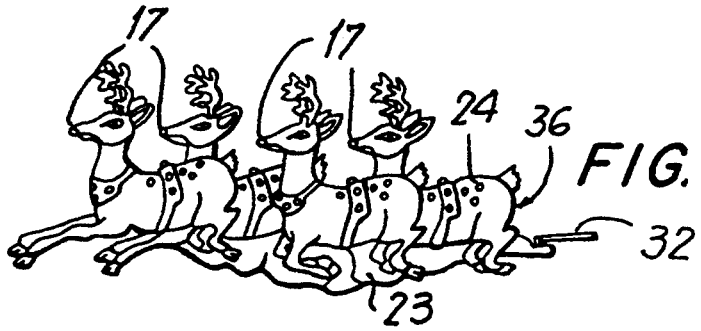
FIG. 3
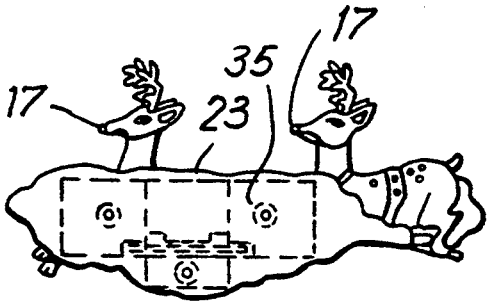
FIG. 4
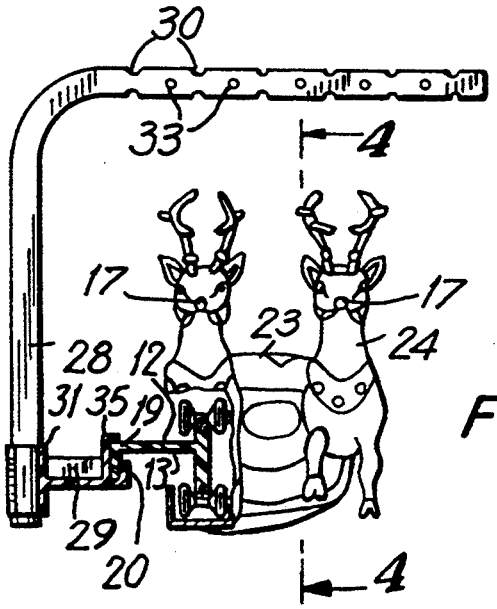
FIG. 5

36
11
38
14
13
14a
37
41
16b
39
40
45
46
52
50
47
26
49
48
46
13
52
41
14
37
52
26
16b
14a
47
38

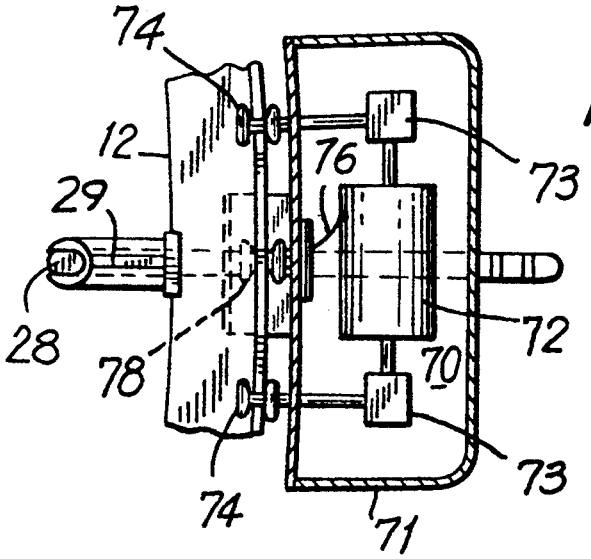
FIG. 9
FIG. 10
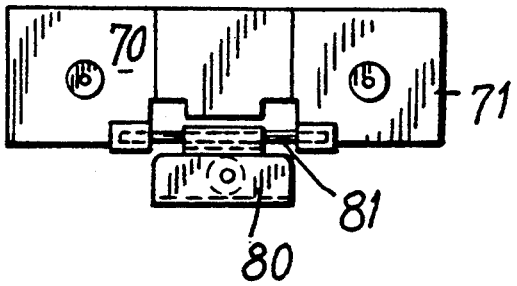
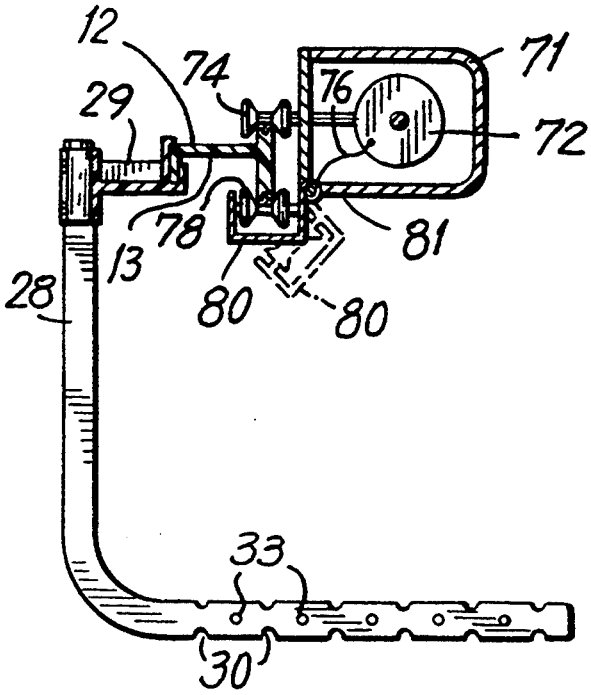
FIG. 11

TRACK DISPLAY

This is a continuation of application Ser. No. 08/044,294 filed on Apr. 7, 1993, now abandoned.

FIELD AND BACKGROUND OF THE INVENTION

The present invention relates in general to animated displays including rails or tracks along which an ornament moves, and in particular to a new and useful track display having a powered track assembly on which an ornament, for example, Santa's sleigh and reindeer, can travel.

Track toys which simulate railroads or automotive roads are well known. See for example, U.S. Pat. No. 3,179,063 which discloses a powered railroad on which a toy train can operate used in conjunction with a powered road bed on which toy cars can travel. U.S. Pat. No. 2,711,857 discloses a model railroad track and a structure for applying electrical power to the track.

U.S. Pat. No. 3,646,892 discloses a traction unit for an electric model railroad train for facilitating powering the electric train and facilitating its movement along a track.

Various mechanisms are also known for moving seasonal ornaments along a path. For example, U.S. Pat. Nos. 3,858,339, 3,820,265 and 5,077,922 all disclose structures for moving Santa with his sleigh and reindeer along a path, or in a repeating animated manner.

U.S. Pat. No. 4,989,120 discloses an ornament in a form of a sphere containing a sleigh and horse which rotates within the ornament. Power is applied in a sequential manner to lighting associated with the ornament for enhancing the display.

SUMMARY OF THE INVENTION

An object of the present invention is to provide a track display apparatus comprising: an elongated track; a pair of spaced apart conductive rails extending along the track; a power supply operatively connected to the track for applying electrical power between the rails; an ornament mounted for movement along the track; motor means in the ornament; at least one roller in rolling engagement with each rail for receiving the electrical power, said motor means being connected to each roller for receiving electrical power for rotating at least one of said rollers to move the ornament along the track; and a plurality of supports connected to and spaced along the track for supporting the track, the supports being shaped so that the ornament may pass each support without obstruction.

A further object of the present invention is to form a track into an endless loop, preferably a circle, and to shape the supports so that they can either support the track above the floor or on another display, for example, a Christmas tree.

A still further object of the invention is to provide the ornament in the form of a miniature sleigh and a plurality of tiny reindeer for simulating Santa's sleigh ride along the track.

The track is advantageously shaped like a lower case h in cross-section. The supports are connected to the smaller leg of the h and have an L-shaped extensions for allowing the reindeer and sleigh to pass along the track. A pair of rails are on opposite ends of the long leg of the h. A housing with one or more motors is advantageously provided. If more than one motor is used, each of the motors includes a shaft with a roller engaging the top rail. If a single motor is used, that motor operatively drives two such shag. A third roller engages the bottom rail. The rollers are spool shaped so that once engaged to the rails, the housing is firmly supported on the track and movable along the track. The motor housing is advantageously partially surrounded by a disguising means such as a cloud-shaped formation through which the reindeer are flying. Alternatively, the motor may be mounted in the sleigh. This effectively camouflages the motor housing. There are numerous alternatives to the use of clouds as cover such as mounds of snow, ocean waves or the like. With the track mounted on a Christmas tree, the track itself is obscured among the tree branches so that a convincing simulation of Santa with his sleigh and reindeer riding around the Christmas tree is produced.

A still further object of the invention is to provide a track display apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 2 is a top plan view of an ornament for movement around the track of the display;

FIG. 3 is a side elevational view of a forward part of the ornament;

FIG. 4 is a view similar to FIG. 3 with two of the reindeer eliminated to show underlying structure and taken generally along line 4—4 of FIG. 5;

FIG. 5 is a front elevational view of the forward part of the ornament;

FIG. 9 is a top plan view of the drive unit for the ornament of the invention mounted on a track section;

FIG. 10 is an inside elevational view of the drive unit; and

FIG. 11 is a sectional view of the drive unit.

DESCRIPTION OF THE PREFERRED EMBODIMENTS

Figure 1:
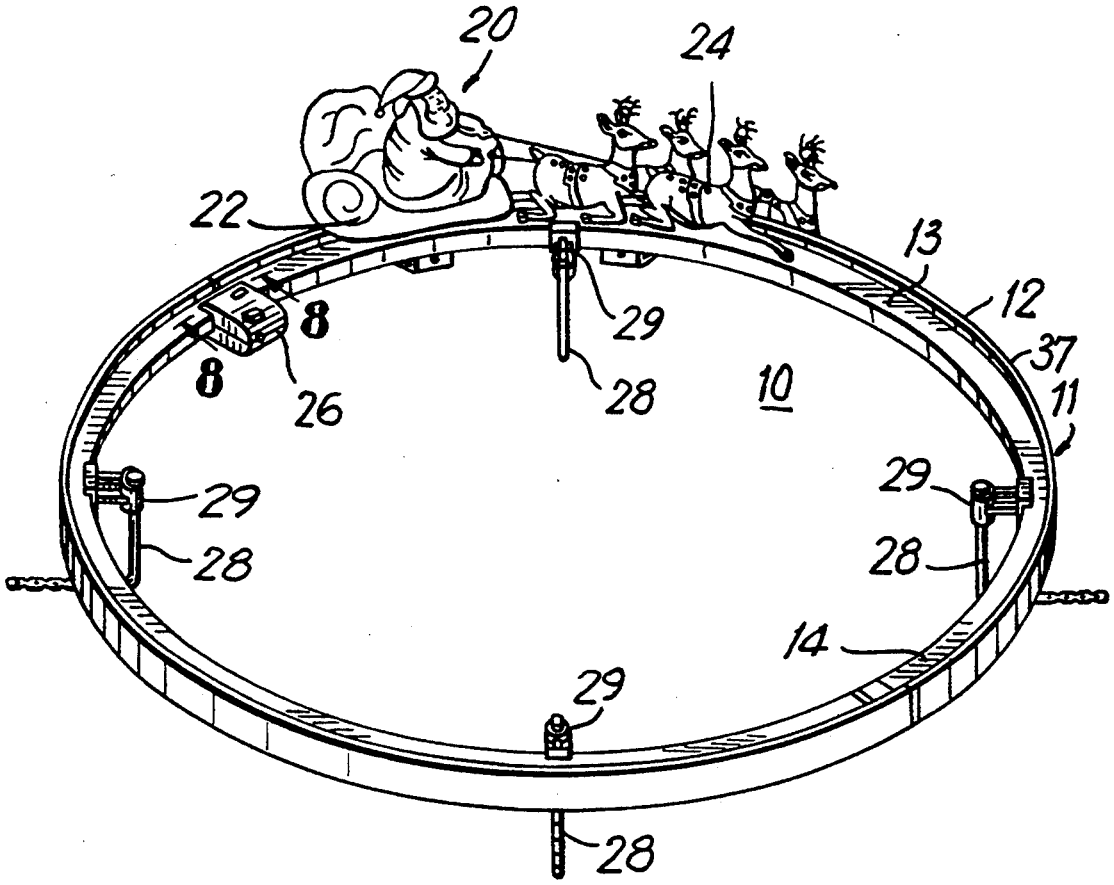
FIG. 1 is a schematic perspective view of the track display apparatus of the invention.

Referring to the drawings in particular, the invention embodied in FIG. 1 comprises a track display apparatus generally designated 10 having a track 12 which is preferably an endless loop or ring comprising a plurality of track sections, here illustrated by, two track sections 14 and 16 which are each semicircular.

An ornament generally designated 20 is mounted for movement around the track. In the embodiment of FIG. 1, the ornament comprises a sleigh 22 containing Santa and a bag of toys which is pulled by a team 24 of four reindeer surrounding a cloud structure 23 that contains and conceals the drive unit of the invention. Alteratively other suitable designs such as a locomotive, a boat, an automobile or other shape may be used. Adjacent ends of the semicircular track sections 14 and 16 are electrically and mechanically coupled to each other by U-shaped connectors 18 preferably made of a material such as steel which imparts a spring action when the connectors 18 are mounted in track sections 14 and 16. The track sections are electrically connected to each other and to a source of electrical energy by a power supply 26.

Figure 12:
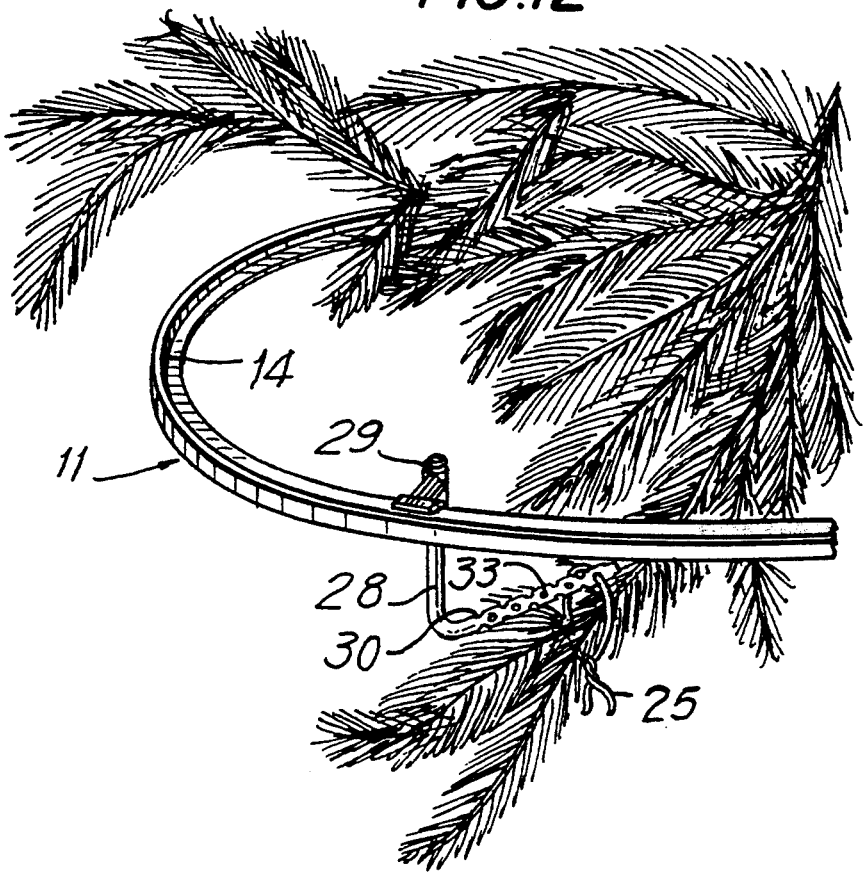
FIG. 12 is a perspective view of a portion of a track in accordance with the present invention mounted in a tree with the support positioned below the track.
Figure 13:
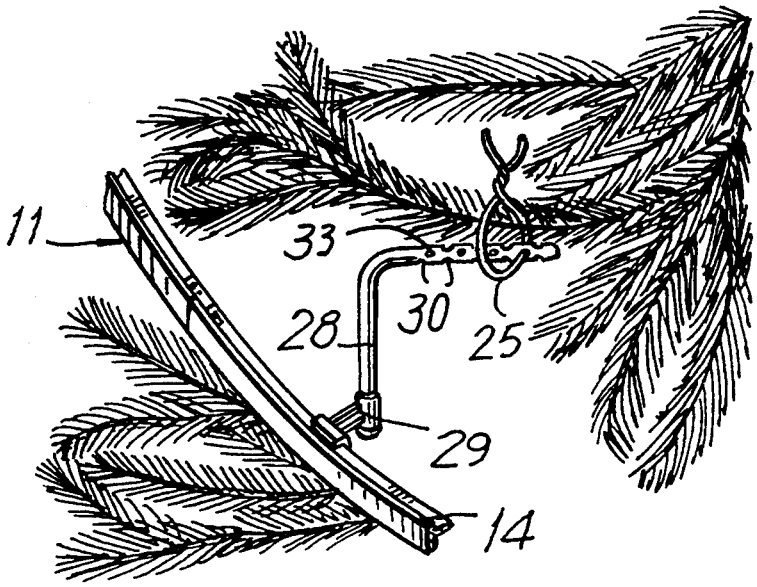
FIG. 13 is a perspective view of a portion of a track in accordance with the present invention mounted in a tree with the support positioned above the track.

A plurality, for example, four supports 28 are connected at spaced locations around the track 12 and are shaped so that they can either support the track from below or suspend the track from any desired structure, such as branches of a Christmas tree as seen in FIGS. 12 and 13. The supports 28 are connected to the track 12 by attaching means 29 by snapping in and out of a "c"-shaped channel 31 in attaching means 29 allowing the direction of supports 28 to be reversed from a position beneath the track 12 to over the track 12. The supports 28 can be attached to a supporting structure such as a Christmas tree by wire ties 25 or the like as seen in FIGS. 12 and 13. The ties 25 may be positioned around notches 30 or through holes 33 in support 28 at one end and around projections such as branches in the supporting structure at the other as seen in FIGS. 12 and 13. Each support is shaped so that the ornament 20 can move freely around the track and pass the supports without obstruction.

FIG. 5 illustrates the interconnection of support 28 with track 12 by connector 29. Track sections 14 and. 16 making up track 12 have identical cross-sections in the form of a lower case h. Leg 19 of track 12 mates with a corresponding receptacle 35 on attaching means 29 to allow removable attachment to track 12. Although two track sections are shown in the illustrated embodiment, any advantageous number of track sections can be utilized to form either an open or endless track.

FIG. 2 is a top plan view of a portion of track 12, one of the supports 28 and the ornament 20. Santa and his sleigh 22 are held by two connections to the reindeer team 24, that is, a coupling 32 between the sleigh and the rear end of the cloud structure 34, and by a simulated rein 25 between the reindeer team and Santa's left hand.

As seen in FIG. 3, lights may also be provided on the ornament. Advantageously, each of the reindeer has a colored light 17 as its nose, further adding to the ornamentation. The sleigh may also have lanterns 15 at its front and back. Power for each of the lights and lanterns is supplied from the power supply 26 as more fully disclosed hereinafter.

As best shown in FIG. 4, a generally rectangular drive unit is concealed and encased within the cloud 23 and between and among the reindeer 24.

Figure 6:
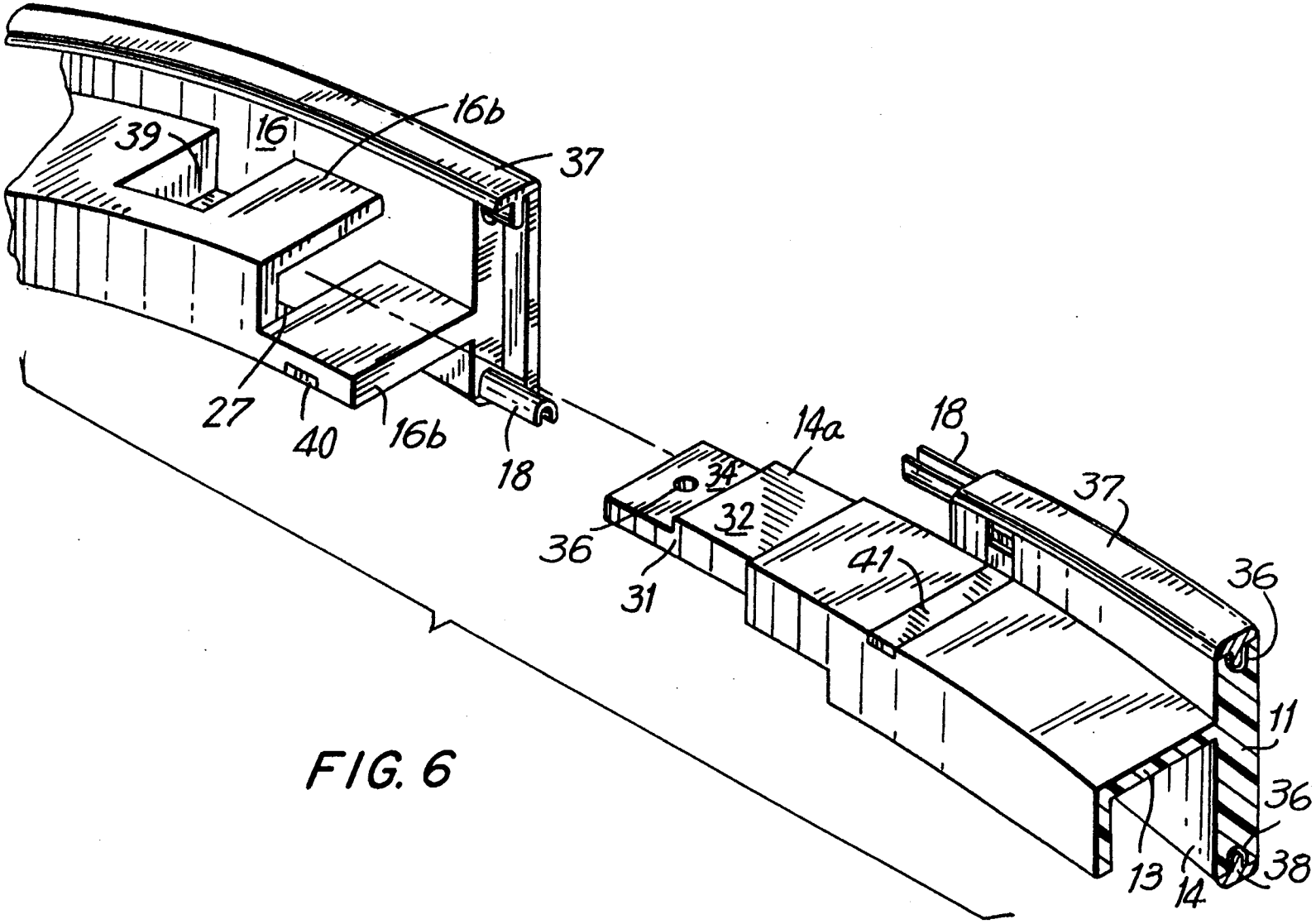
FIG. 6 is an exploded view of a connecting ends of two track sections of the invention showing the structure for linking the sections together.
Figures 7, 8:
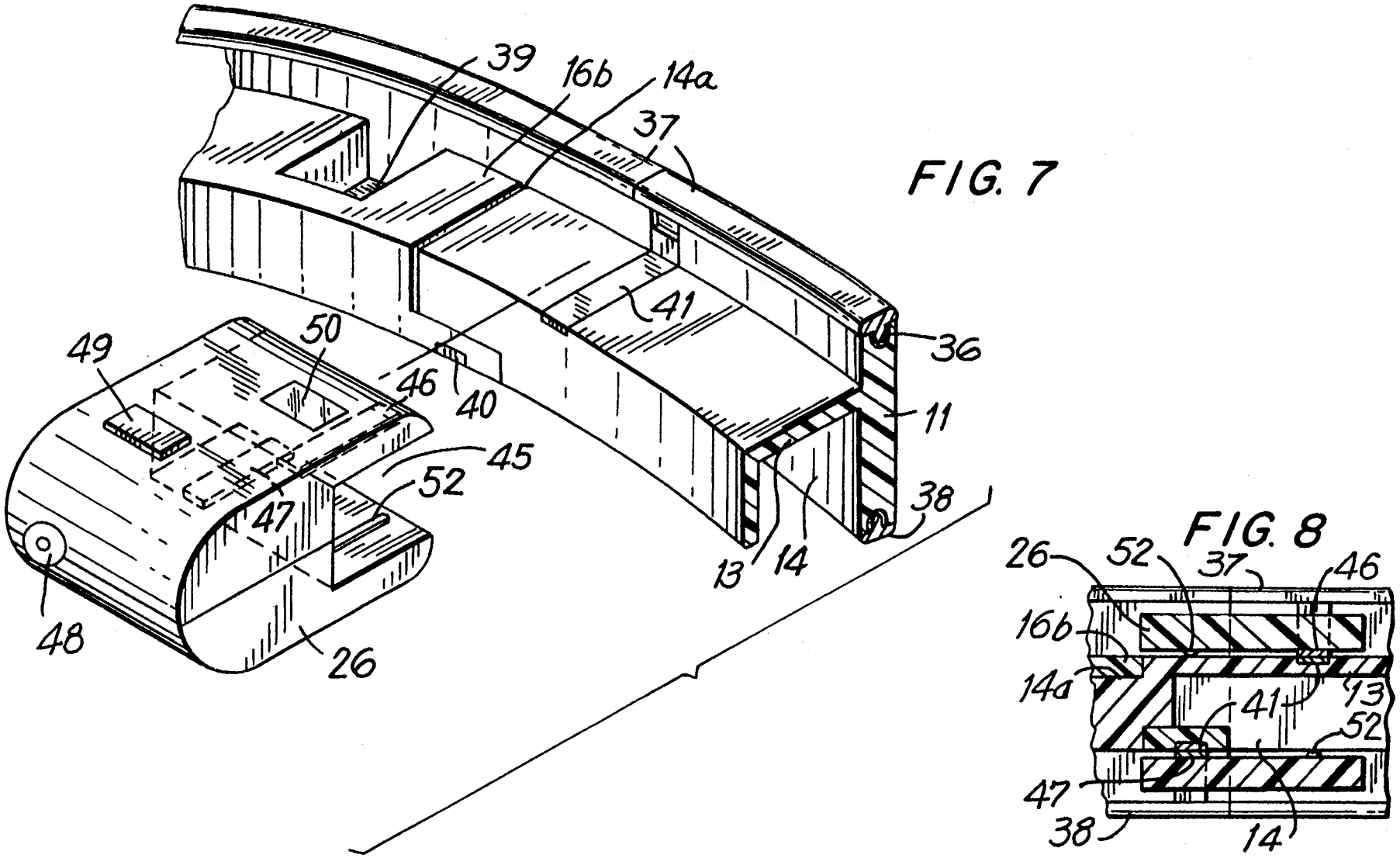
FIG. 7 is a perspective view showing two linked track end sections with a power supply positioned as immediately prior to mounting on the track, the power supply having certain of its internal structure shown by dashed lines.
FIG. 8 is a cross section view of plane 8—8 in FIG. 1 showing the electrical interconnector of the two track ends of FIG. 7.

As most clearly seen in FIG. 6, track section 14 has at one end **14*a* a stepped projection 21 which mates with the opposite end 16*b* of track section 16. FIG. 7 show's the respective track ends 14*a* and 16*b* in the mated position. Projection 31 consists of two steps 32 and 34. The top surface of step 34 positioned below the top surface of step 32. Step 32 in mm is positioned below the top surface of leg 13 of track 12. Projection 21 mates with a receptacle 27 at the opposite end of track 16. When so mated the bottom of step 34 rests on surface 39 in track section 16. Surface 39 has a projection (not shown) sized and positioned to mate with hole 34*a* in step 34, thereby acting to hold track sections 14 and 16** together.

In the closed position, track sections 14 and 16 are also held together by electrically conducting U-shaped connectors 18 which are inserted in channels 36 in either end of leg 11 of track sections 14 and 16. Rail 37, formed from an electrically conductive material, is positioned in channel 36, at one end of leg 11 and conductive rail 38 is positioned in the channel 36 at the other end of leg 11. Rails 37 and 38 on track section 14 are in electrical connection with corresponding mils 37 and 38 on track section 16 by connectors 18.

FIG. 6 shows one end of track section 16 and another end of track section 14. The end of track section 16 not shown is the same as track section 14 and the other end of track section 14, not shown, is the same as the end of track 16 shown in FIG. 6. Thus, track sections 14 and 16 can meet with and join the corresponding opposite end of the next track section to form two continuous conductive rails 37 and 38 around the entire loop of track 12.

The connector 18, which is in electrical contact with rail 37 of track section 14, is an electrical contact with conductor strip 41. Similarly the conductor 18, at the opposite end of leg 11, is similarly in electrical contact with rail 38 and at the opposite end of track section 14 with strip 40, as shown with regard to corresponding track section 16 in FIG. 6. Connector 18, and strip 40 or strip 41 as the case may be, may be formed from a single continuous piece of conductive material.

As seen in FIGS. 7 and 8, power supply 26 has a center opening 45 of such a size and shape that it may be slidably mounted over ends **14*a* and 16*b* of track sections 14 and 16. Power supply 26 has two conductive strips 46 and 47. When, power supply 26 is mounted on rails 14 and 16, conductive strip 46 is in electrical contact with strip 41 on track section 14 and conductive strip 47 is in electrical contact with strip 40. Strip 46 and 47 are in electrical contact with conventional electrical plug 48 by standard means such as wires (not shown). Plug 48 is of a conventional design to receive low voltage direct current from a transformer or the like. Switch 49 is positioned between conductive strip 46 and 47 and plug 49. In one position it allows current to flow to conductive strips 46 and 47 from plug 48 and when the switch 49 is in a second position, the flow of electricity is interrupted. Thus, when switch 49 is in the closed position, current is allowed to flow to rails 37 and 38. Indicator 50 acts to visually indicate if switch 49 is in the opened or closed position. Projection 52 on power supply 26 holds the power supply 26 in proper position on track sections 14 and 16**.

FIGS. 9, 10 and 11 show the drive unit 70 in greater detail. The drive unit comprises a housing 71 of substantially rectangular configuration, containing a low voltage electric motor 72, mechanically connected by gears 73 to two shafts carrying a spool-shaped roller 74. At least one of said rollers is made of conductive material, such as a single piece of bushing brass. Rollers 74 roll against the upper conductive rail 37 and supply one pole of the electrical power needed to drive motor 72.

The opposite electrical pole is connected by wire 76 to the housing or bushing of a lower conductive spool shaped roller 78. Roller 78 is mounted in a U-shaped roller support 80 that is connected by a hinge 81 to the lower end of housing 71. As seen in FIG. 11, support 80 can be pivoted in from the lower phantom line position to its upper solid line position. This is done to mechanically lock and mount the drive unit 70 (and its surrounding ornament) to the upper and lower rails 37 and 38 of the track 12 and thus also provide electrical connection between the power supply 26 and lights 15 and 17. When switch 68 is slid to its "ON" position, power is supplied to the lights and motors which cause their sharks and rollers 74 to rotate, driving Santa and his sleigh around the track.

Instead of a single motor 72 and gear 73, two separate motors may be mounted in housing 71 (not shown).

In order to add support to the entire ornament 20, the sleigh may also be mounted on rollers in a manner similar to that of rollers 74 and 78. The rollers may be either be non-conductive or be conductive. If conductive they maybe electrically connected to lights 15. A sound source such as a conventional sound chip and speaker may be mounted in the sleigh and electrically connected to said rollers to produce appropriate music and/or sound effect when current is supplied to rails 37 and 38.

While a specific embodiment of the invention has been shown and described in detail to illustrate the application of the principles of the invention, it will be understood that the invention may be embodied otherwise without departing from such principles.

What is claimed is:

1. A track display apparatus comprising:

an elongated track;

a pair of spaced apart conductive rails extending along the track;

a power supply operatively connected to the track for applying electrical power between the rails;

an ornament mounted for movement along the track;

a motor in the ornament:

two rollers, one roller in rolling engagement with each rail for receiving the electrical power, said motor being connected to said two rollers for receiving electrical power such that the motor drives the ornament along the track when the rails are receiving power;

a plurality of support means connected to and spaced along the track for supporting the track, the support means being shaped so that the ornament may pass each support means without obstruction; and said track having an h-shaped cross-section having a long leg and a short leg and a third leg connecting them, said support means being connected to said short leg.

2. An apparatus according to claim 1 wherein a drive shaft connected to said motor, said drive shaft being directly driven by said motor;

one of said rollers is mounted on said drive shaft of said motor so that it is directly driven by the drive shaft which is in turn driven by the motor, thereby moving the ornament along the track.

3. An apparatus according to claim 1 wherein the pair of rails are positioned spaced from each other on the long leg of the track's h-shaped cross-section.

4. An apparatus according to claim 3 wherein said track comprises a plurality of track sections connected end to end to form an endless loop.

5. An apparatus according to claim 4 including a pair of spaced apart conductive contact areas at each end of each track section, said contact areas being adapted for electrical connection to contact areas at an opposite end of a track section for connecting one track section to another track section, each contact area being electrically connected to one of said rails.

6. An apparatus according to claim 5 wherein the power supply comprises a housing having a U-shaped opening for coupling around two track section ends where the track sections meet in said track, and means for electrically engaging at least one of said contact areas of said track sections.

7. An apparatus according to claim 3 wherein a second roller attached to the motor means engages the rail on the other end of the long leg of the track's h-shaped cross-section.

8. An apparatus according to claim 1 wherein each of the support means comprise brackets connected to the track and extensions connected to the brackets of a size to allow passage of the ornament along the track and past the support means.

9. An apparatus according to claim 8 wherein the extensions are detachably mounted on said brackets by means which allows the extensions to be positioned vertically, above or below the track.

10. An apparatus according to claim 9 wherein the extensions are L-shaped and can be rotated around their vertical axis.

11. An apparatus according to claim 1 wherein said support means are adapted to be attached to branches of a tree.

12. An apparatus according to claim 11 in combination with a tree wherein said track is mounted on a tree by said support means and the support means are attached to branches of the tree.

13. An apparatus according to claim 12 wherein wire ties are employed to attach the support means to branches of the tree.

14. An apparatus according to claim 13 wherein the ornament comprises a team of reindeer and a sleigh connected to the team of reindeer for movement with the team of reindeer along the track.

15. A track display apparatus in combination with a tree comprising:

an elongated track forming a closed endless loop mounted in the tree;

a pair of spaced apart conductive rails extending along the track;

a power supply operatively connected to the track for applying electrical power to the rails;

an ornament mounted for movement along the track;

a motor in the ornament;

two rollers, one roller in rolling engagement with each rail for receiving the electrical power, said motor being operationally connected to each roller for receiving electrical power such that the motor drives the ornament along the track when the rails are receiving power; and a plurality of means connected to and spaced along the track for supporting the track in the tree by attachment to branches of the tree while allowing the ornament to pass each support means without obstruction and means for attaching said support means to branches of the tree.

16. An apparatus according to claim 15 wherein the track is mounted around said tree.

17. An apparatus according to claim 16 wherein said support means comprise brackets connected to said track and extensions connected to the brackets of a size to allow passage of the ornament along the track, past the support means and around the tree.

18. An apparatus according to claim 17 wherein the extensions are detachably mounted on said bracket by means which allows the extension to be positioned vertically, above or below the track for attachment to the tree.

19. An apparatus according to claim 18 wherein the extensions are L-shaped and can be rotated around their vertical axis.

20. An apparatus according to claim 16 wherein the means for attaching said support means to the branches of the tree are wire ties.

21. An apparatus according to claim 15 wherein a drive shaft is connected to said motor, which drive shaft is directly driven by said motor, one of said rollers being mounted on said drive shaft.

22. An apparatus according to claim 15 wherein the track has an h-shaped cross-section, the track's h-shape cross-section having a long leg and a short leg and a third leg connecting them, said support means being connected to said short leg.

23. An apparatus according to claim 22 wherein the long and short leg extend vertically and the leg which connects them extends horizontally.

24. An apparatus according to claim 22 wherein the pair of rails are positioned spaced from each other on the long leg of the track's h-shaped cross-section.

25. An apparatus according to claim 15 wherein said track comprises a plurality of track sections connected end to end to form the endless loop.

26. An apparatus according to claim 25 including a pair of spaced apart conductive contact areas at each end of each track section, said contact areas being adapted for electrical connection to contact areas at an opposite end of a track section for connecting one track section to another track section, each contact area being electrically connected to one of said rails.

27. An apparatus according to claim 26 wherein the power supply comprises a housing having a U-shaped opening for coupling around two track section ends where the track sections meet in said tracks, and means for electrically engaging at least one of said contact areas of said track sections.

28. An apparatus according to claim 15 wherein the ornament comprises a team of reindeer and a sleigh connected to the team of reindeer for movement with the team of reindeer along the track.

* * * * *